United States Patent [19]

Kawai

[11] 3,999,984

[45] Dec. 28, 1976

[54] METHOD OF ADDING METALLIC ADDITIVE TO MOLTEN METAL OF HIGHER TEMPERATURE THAN BOILING POINT OF THE ADDITIVE

[75] Inventor: Teiichi Kawai, Suita, Japan

[73] Assignee: Kubota, Ltd., Osaka, Japan

[22] Filed: Sept. 30, 1975

[21] Appl. No.: 618,266

[30] Foreign Application Priority Data

May 12, 1975 Japan ..... 50-56400

[52] U.S. Cl. ..... 75/130 A; 75/65 R; 266/208

[51] Int. Cl.[2] ..... C22C 33/08

[58] Field of Search ..... 75/130 A, 130 R, 65, 75/49; 266/208, 216

[56] References Cited

UNITED STATES PATENTS

| | | | |
|---|---|---|---|
| 2,781,260 | 2/1957 | Grandpierre | 266/216 |
| 3,896,870 | 7/1975 | Massoubre | 266/216 |

*Primary Examiner*—Peter D. Rosenberg
*Attorney, Agent, or Firm*—Wenderoth, Lind & Ponack

[57] ABSTRACT

A method of adding a metallic additive to a molten metal having a temperature higher than the boiling point of the metallic additive comprises introduction of the metallic additive into the molten metal while the pressure within a double-walled ladle structure is adjusted to a value substantially equal to 70 to 85% of the vapor pressure evolved by the vaporization of the metallic additive. The method employs the double walled ladle structure having an adiabatic space formed between inner and outer containers which constitute the ladle structure together with a lid adapted to close the top opening of the ladle structure to enable the pressure within the ladle structure can be adjusted to the predetermined value.

3 Claims, 3 Drawing Figures

METHOD OF ADDING METALLIC ADDITIVE TO MOLTEN METAL OF HIGHER TEMPERATURE THAN BOILING POINT OF THE ADDITIVE

BACKGROUND OF THE INVENTION

The present invention relates to a method of adding a metallic additive to a molten metal having a temperature higher than the boiling point of the metallic additive.

In the manufacture of, for example, nodular graphite cast iron, magnesium having a relatively low solid solubility is added to a molten cast iron. It is well known that, during the manufacture thereof, the temperature of the molten cast iron is within the range of 1,300° to 1,500° C. on one hand and the magnesium to be added thereto has a melting point of about 651° C. and a boiling point of about 1,110° C. Because of this temperature difference, addition of magnesium to the molten cast iron under the atomospheric pressure results in that the magnesium is excessively excited to explosion. This is very hazardous to attendant workers.

Moreover, during the addition, magnesium particles to be added tend to be spattered over the ladle in contact with the molten cast iron and an insufficient amount of magnesium is consequently added to the molten cast iron. At the same time, since this addition causes the magnesium particles to transform from the solid state into the molten state absorbing heat energies evolved by the molten cast iron, the temperature of the molten cast iron tends to be lowered. In addition, in order for graphite to be sperodized, the magnesium particles must be uniformly dispersed in the molten cast iron during the manufacture.

Heretofore, the following methods are employed to add magnesium to a molten cast iron:

1. The intended addition is carried out within a protective container;
2. Magnesium to be added is introduced into the molten cast iron in an alloy or bricket form; and
3. Magnesium is added to the molten cast iron under the atmosphere wherein the pressure is higher than the vapor pressure of the magnesium.

With respect to the methods (1) above, the method has been contemplated not only to minimize a possibility of danger by constructing a ladle in the form of a protective container, but also to cause the magnesium and the molten cast iron to uniformly contact to each other by the stirring action of the molten cast iron which results from explosion occuring upon introduction of the magnesium into the molten cast iron. In practice, however, this method has been found that minimization of the possibility of danger is insufficient and that addition of the magnesium to the molten cast iron often causes the temperature of the molten cast iron to decrease with a relatively large amount of the magnesium being ineffectively consumed.

With respect to the method (2) above, any of Ni-Mg alloy, Cu-Mg alloy and Fe-Si-Mg alloy is employed in place of pure magnesium. This alloy in a powdery form is, prior to being actually added to the molten cast iron, mixed with a binding agent to render it in the form of brickets or lumps. Although the use of the alloy or bricket is advantageous in that it can slowly be fused into the molten cast iron with successive explosion on small scale occurring therein so that the magnesium particles can uniformly be dispersed into the molten cast iron, the alloy itself is very expensive and, moreover, since the alloy or the bricket contains one or more substances other than magnesium and a relatively large amount of heat energies is required to fuse such substances in addition to that required to fuse the magnesium particles, the temperature of the molten cast iron tends to be lowered.

With respect to the method (3) above, the method has been contemplated to cause the added magnesium to be substantially completely fused into the molten cast iron without accompanying any explosion which may otherwise occur upon introduction of the magnesium into the molten cast iron. In practice, however, since there is relatively great difference in specific weight between the magnesium and the molten cast iron, uniform distribution of the magnesium particles in the molten cast iron can hardly be achieved without the aid of an external mechanical stirring instrument or without a support for metallic additive, such as the magnesium, being moved up and down to stir the molten cast iron. In other words, the method (3) above requires for a ladle structure not only to be constructed in the form of a container which can withstand against the elevated temperature and considerably high pressure, but also to be equipped with an external stirring instrument. Accordingly, the ladle structure used in the practice of the method (3) above requires a complicated handling procedure and is often liable to troubles and, therefore, the method is not practically effectively carried out.

SUMMARY OF THE INVENTION

Accordingly, the present invention has for its essential object to provide an improved method of adding a metallic additive to a molten metal having a temperature higher than the melting point of the metallic additive, which substantially eliminates the various disadvantages inherent in the hereinbefore described methods.

Another important object of the present invention is to provide an improved method referred to above, which does not substantially involve any danger to attendant workers because of a specially designed ladle structure being used for the practice of the method of the present invention.

According to the present invention, an essential feature resides in that a major portion of the metallic additive to be added is caused to fuse for the purpose of preventing it from excaping out of the molten metal and also for effectively and uniformly dispersing it into the molten metal while the remaining portion of the metallic additive is caused to boil in the molten metal to effect a stirring action necessary to uniformly mix the additive with the molten metal. In order to achieve this, the method of the present invention utilizes a double-walled ladle structure which comprises an inner container, the interior surface of which is lined with a refractory lining, and an outer container in which the inner container is accommodated with an adiabatic space formed therebetween, a plurality of vent passages formed in an annular flange radially outwardly extending from the inner container adjacent the top opening of the inner container, and a lid adapted to close the top opening of the inner container and, therefore, that of the ladle structure to define a substantially hermetically sealed working chamber above the surface level of the molten metal within the ladle structure, which working chamber is communicated with adiabatic space through the vent passages.

While the details of the double-walled ladle structure referred to above are herein disclosed, the method of the present invention is carried out while the pressure within the working chamber and, therefore, the adiabatic space is adjusted to be a value smaller than the vapor pressure of the metallic additive by 15 to 30% of the latter. While the working chamber and the adiabatic space are simultaneously controlled to have a definite pressure, the metallic additive is subsequently introduced into the molten metal by way of a perforated or pierced refractory container adapted to be immersed into the molten metal.

More particularly, it has been found that, when magnesium is added to a molten cast iron during the manufacture of, for example, nodular graphite cast iron, the vapor pressure evolved by the magnesium being added varies depending upon the temperature of the molten cast iron as tabulated below.

| Temp. of Molten Cast Iron (° C) | Vapor Pressure of Magnesium (Kg/cm²) |
|---|---|
| 1,300 | 3.5 |
| 1,350 | 5.1 |
| 1,400 | 7.2 |
| 1,450 | 10.1 |
| 1,500 | 14.3 |

If the pressure exerted within the ladle is higher than the vapor pressure at the time of addition of magnesium to the molten cast iron of a particular temperature, magnesium particles will be fused into the molten cast iron without substantially being boiled by the effect of the elevated temperature of the molten cast iron. On the other hand, if the pressure exerted within the ladle is lowered, the amount of magnesium particles to be boiled in the molten cast iron increases in proportion to reduction of the pressure exerted within the ladle.

Accordingly, it can be concluded that, if the magnesium is introduced into the molten cast iron while the pressure exerted within the ladle is properly adjusted to a value adequately lower than the vapor pressure, a major portion of the magnesium particles can be fused into the molten cast iron while the rest thereof are boiled. Specifically, if the pressure exerted within the ladle is adjusted so as to attain a value lower than the vapor pressure by 15 to 30% of the latter at the time of addition of the magnesium particles to the molten cast iron within the ladle, a major amount of the magnesium particles are, as they are readily fused into the molten cast iron, mixed into the molten cast iron to effectively spherodize a graphite component of the cast iron while the rest thereof are boiled to effect a stirring action to uniformly disperse the whole magnesium particles into the molten cast iron. If the pressure exerted within the ladle is not more than 70% of the vapor pressure described above, an amount of the magnesium particles boiled will become so great that the magnesium upon vaporization tends to escape out of the ladle with a consequent reduction of the yield thereof and that the temperature of the molten cast iron will be reduced by the action of latent heat evolved by the vaporization of the magnesium added. On the other hand, if the pressure within the ladle is not less than 85% of the vapor pressure described above, sufficient mixture of the magnesium with the molten cast iron can not be achieved and, therefore, spherodization of a graphite component will be insufficient.

In the practice of the foregoing method, however, the ladle used to accommodate a predetermined amount of molten cast iron must be of such a design that a substantially hermetically sealed space can be formed within the ladle and above the surface level of the molten metal within said ladle to allow space to be pressurized to 70 to 85% of the vapor pressure of the magnesium being added and, at the same time, the ladle can stand against such a high pressure. Where a ladle of a conventional pressure-resisting construction is used in the practice of the foregoing method, the conventional ladle will be subjected to an abnormal pressure exceeding the designed pressure against which the conventional ladle can withstand, particularly immediately after the magnesium has been added. This is because, although the temperature within a refractory container, which is used to accommodate therein a required amount of magnesium to be added and through which the magnesium is, while said container is introduced into the molten cast iron, released into the molten cast iron, is lowered under the influence of latent heat, evolved upon vaporization of the added magnesium, as the time passes and the reaction within the container is therefore brought to an equilibrium, the magnesium added is rapidly vaporized immediately after it has been introduced into the molten cast iron through the refractory container. In view of this, the conventional ladle cannot be relied on in the practice of the method of the present invention due to an insufficient physical strength with respect to the elevated temperature and rapid variation in pressure.

BRIEF DESCRIPTION OF THE DRAWING

These and other objects and features of the present invention will become apparent from the following description taken in conjunction with a preferred embodiment thereof with reference to the accompanying drawings, in which.

DETAILED DESCRIPTION OF THE INVENTION

Figure 1:
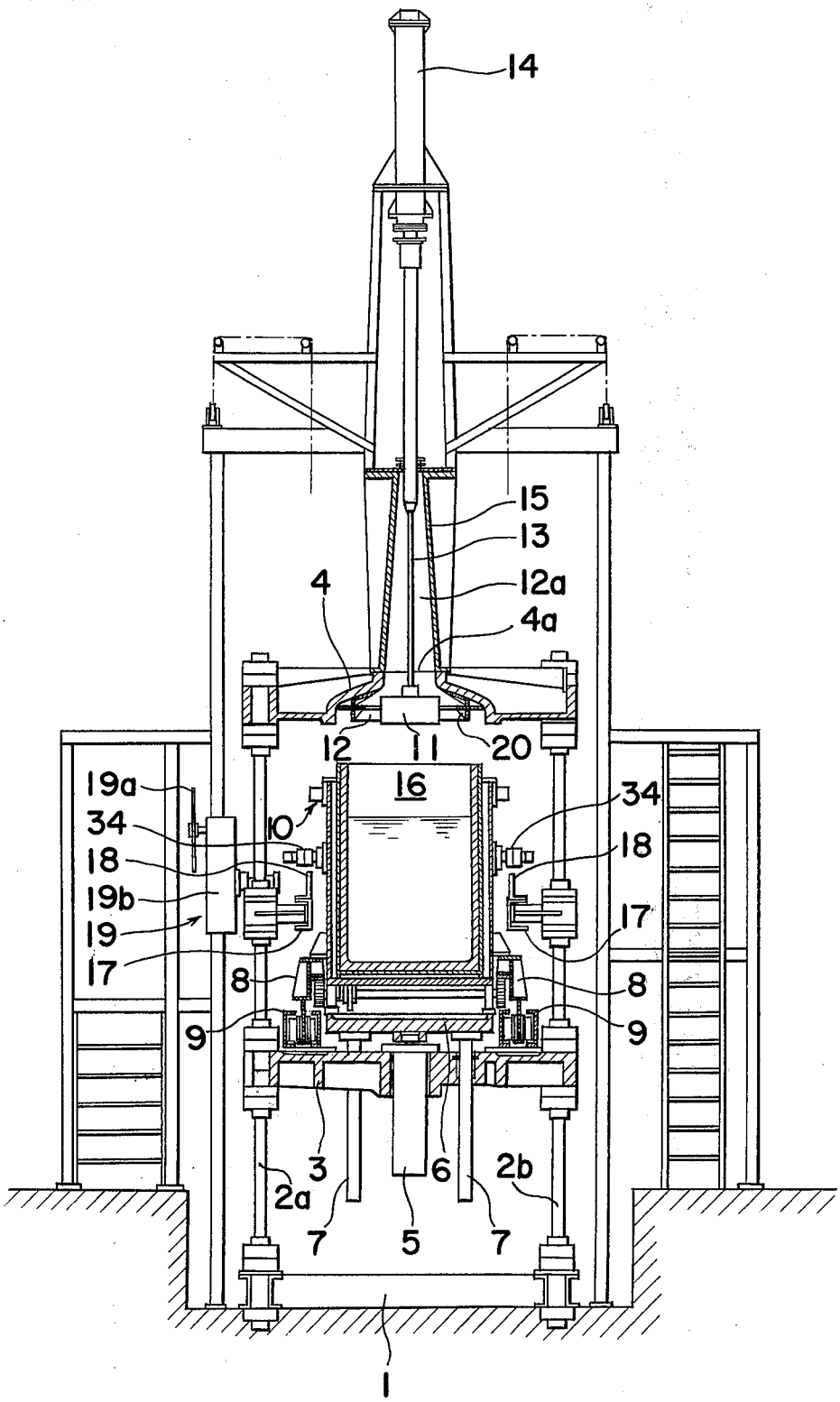
FIG. 1 is a front elevational view, with a portion shown in section, of an apparatus for adding a metallic additive to a molten metal, which is used in the practice of the method of the present invention.

A ladle structure used in the practice of the method of the present invention is constructed of a double-walled structure and has inner and outer, open-topped containers, the inner open-topped container being accommodated within the outer open-topped container with the level of opening at the top of the inner container situated above that of the outer container. These inner and outer containers are respectively formed with radially outwardly extending annular flanges adjacent the individual openings at the top of the inner and outer containers so that, in an assembled condition wherein the inner container is held within the outer container with the annular flange of the inner container resting on and welded, or otherwise tightly connected by the use of fastening members, to the annular flange of the outer container. This way, an adiabatic space is formed between the inner and outer containers, which is in turn communicated to the outside through one or more vent passages formed in the annular flange of the inner container.

The ladle herein disclosed includes a lid of a size sufficient to close the top opening of the inner container and the vent passages opening in the annular flange of the inner container. When the lid is placed over the top opening of the container assembly, a working chamber is formed above the surface level of molten metal within the inner container and is communicated to the adiabatic space referred to above.

In the practice of the method of the invention with the use of the ladle herein disclosed, the pressure within the working chamber is controlled to attain a value equal to 70 to 85% of the vapor pressure evolved by the matallic additive of low melting point being mixed into the molten metal for the reason as hereinbefore described. Since the working chamber is in communication with the adiabatic space through the vent passages, the pressure within the adiabatic space is equalized to that within the working chamber and acts as a counter-pressure with respect to the pressure exerted by the molten metal on the inner container.

Moreover, the adiabatic space advantageously minimize heat transmission from the molten metal onto the outer container through the inner container. This means that reduction in temperature of the molten metal within the inner container can be minimized or substantially avoided on one hand and heating of the outer container under the influence of the temperature of the molten metal can also be minimized or substantially avoided on the other hand.

Furthermore, in the practice of the method of the present invention with the use of the ladle structure of the particular construction, the working chamber is first confined by placing the lid tightly onto the top opening of the ladle and the metallic additive to be added is subsequently introduced into the molten metal within the ladle. This introduction is carried out while the pressure within the working chamber is adjusted so as to attain a value equal to 70 to 85% of the vapor pressure evolved by the fusion of the metallic additive being introduced. By so doing this way, a major portion of particles of the metallic additive being introduced can effectively be added to the molten metal and, simultaneously therewith, the rest of the additive particles are boiled in the molten metal to effect a stirring action necessary to uniformly disperse the metallic additive into the molten metal.

Referring to the accompanying drawings and, particularly, to FIG. 1, the mixing apparatus herein disclosed comprises at least one pair of vertically extending columns all rigidly supported on a foundation 1. In the instance as shown, two pairs of volumns 2*a* and 2*b* are employed and one of the columns of each pair 2*a* or 2*b* is not illustrated because of being located behind the other column 2*a* or 2*b*. The columns 2*a* and 2*b* carries a horizontal deck 3 rigidly mounted thereon spaced a predetermined distance from the foundation 1. Adjacent free ends at the top of these columns 2*a* and 2*b*, the latter carry a lid 4, of a structure as will be described in detail later, rigidly mounted thereon spaced a predetermined distance from the horizontal deck 3.

Operatively carried by and mounted on the horizontal deck 3 is a vertically movable platform 5 having guide rods 7 downwardly extending therefrom and slidably supported through the horizontal deck 3. A hydraulic lifting cylinder 5 having a piston rod is rigidly supported by the horizontal deck with the free end of said piston connected to said movable platform 5 whereby, when said cylinder 5 is operated with said piston outwardly projected, said movable platform 5 can be upwardly shifted to an elevated position and, when said cylinder 5 is brought to an inoperative position with said piston inwardly retracted, said movable platform 5, which has been shifted to the elevated position, can be downwardly shifted to a rest position as shown in FIG. 1. The cylinder 5 may of course be of any type and, for example, it may be of a type wherein, only when the piston is to be outwardly projected, supply of fluid medium is required to operate the cylinder while shift of the movable platform 6 from the elevated position to the rest position together with inward retraction of the piston is effected by their own weight simultaneously with discharge of the once-supplied fluid medium out of the cylinder.

A ladle, generally indicated by 10, is mounted on the movable platform 6 through a wheeled carriage 8 situated between said movable platform 6 and the bottom of the ladle 10 and movably mounted on a pair of spaced parallel rails 9 which are provided on the horizontal deck 3. It is to be noted that, when the movable platform 6 is held in the rest position, the wheeled carriage 8 is clear of the movable platform 6 in readiness for movement towards a subsequent working station along the rails 9.

The apparatus further comprises a ladle tilting mechanism, generally indicated by 19, which includes a steering wheel 19*a* and a gear box 19*b* through which a rotational force of the steering wheel 19*a* can be transmitted through a known gear-and-pinion arrangement (not shown) to at least one of trunnions 34 integral with and radially outwardly extending from the ladle 10 in the opposite directions, so that the ladle 10 can be tilted to pour molten metal therefrom onto a container at the subsequent working station.

Reference numerals 18 represent respective brackets for support of the trunnions 34 and, therefore, the ladle 10, which brackets 18 are respectively carried by associated beams 17 secured to the vertical columns 2*a* and 2*b* at a position substantially intermediately of the length of each of the columns 2*a* and 2*b*.

Figure 2:
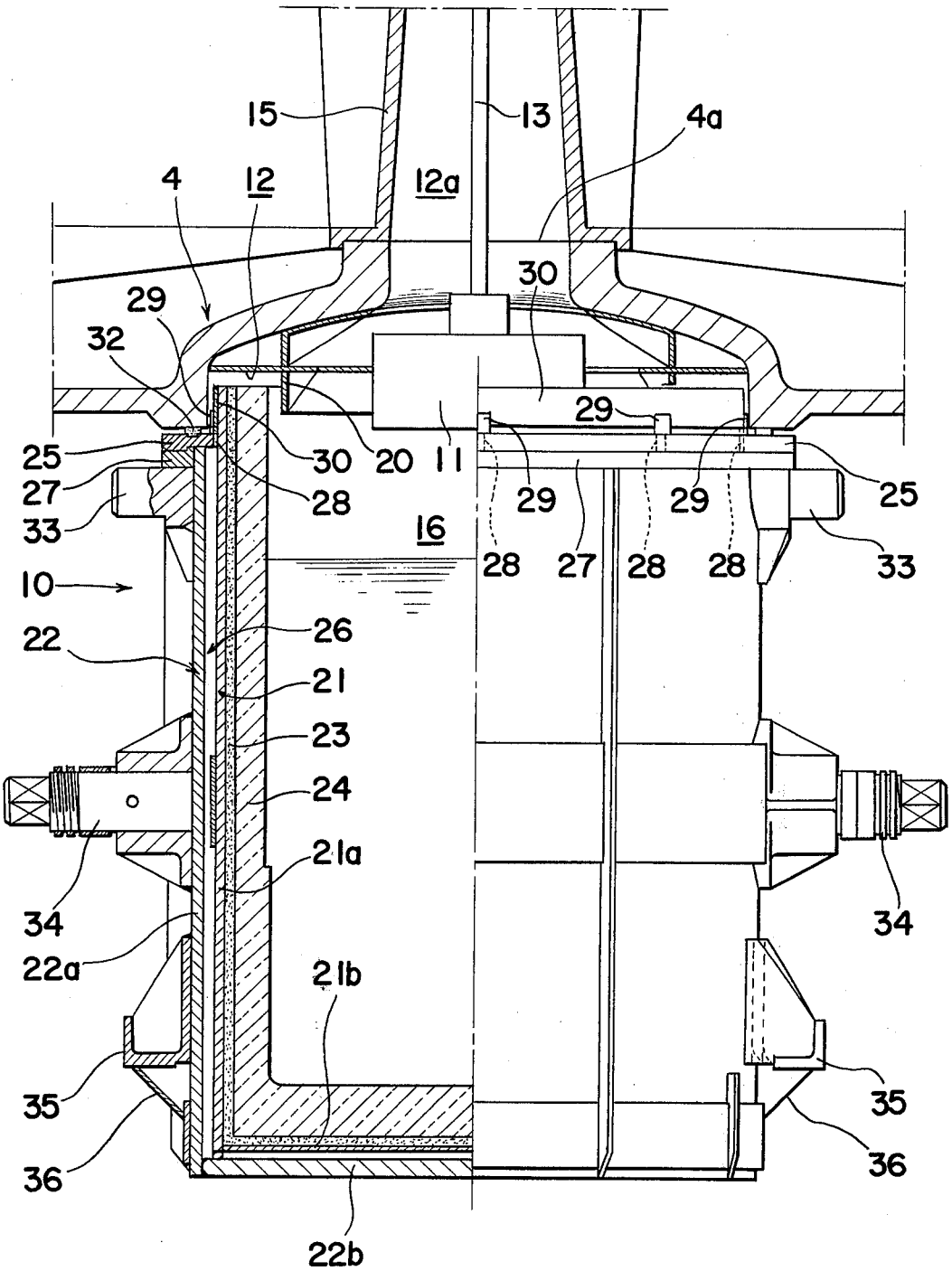
FIG. 2 is a view, on an enlarged scale, of an essential portion of the apparatus of FIG. 1, showing the details of a ladle structure employed in the apparatus of FIG. 1, it being understood that only the left-hand half of the ladle structure is depicted in section and that a lid is depicted in position to close the top opening of the ladle structure.

With particular reference to FIGS. 1 and 2, the lid 4 is substantially of an inverted funnel shape and having a cavity formed therein at 12 for accommodatint therein a refractory container 11 in which a metallic additive is contained in the form of a lump or lumps. The lid 4 also has a central bore 4*a* and is mounted with a shielding sheath 15 in alignment with the central bore 4*a*. The shielding sheath 15 has an interior hollow 12*a* in communication with the cavity 12 and accommodates therein a piston rod 13 having one end detachably connected to the refractory container 11 and the other end operatively connected to a hydraulic lifting cylinder 14 stationarily supported in position above the ladle 10. In the instance as shown, the cylinder 14 is operable in such a manner that, when fluid medium is supplied into one working chamber, the piston rod 13 outwardly projects with the refractory container 11 being downwardly shifted from a lifted position towards an immersed position as will be described later and, when fluid medium is subsequently supplied into the other working chamber with the fluid medium in said one working chamber being discharged, said piston rod 13 is inwardly retracted with the refractory container 11 in the immersed position being upwardly shifted to the lifted position as shown. Alternatively, without the employment of the hydraulic cylinder 14, the piston rod 13 may be adapted to be selectively lowered and elevated by means of a gantry crane.

Although not shown, for the purpose of controlling the pressure within a working chamber defined above the surface level of molten metal within the ladle and including the cavity 12 and the hollow 12*a* as will be described later, gas supply and discharge pipings, which may include pressure gauges disposed thereon, are connected to the shielding sheath 15 for respective introduction and discharge of pressurizing medium.

Reference numeral 20 represents a substantially cylindrical barrier downwardly extending from the lid 4 and having a length sufficient to enter, when the ladle 10 on the movable platform 6 in the elevated position is closed by said lid 4, the top opening of the ladle 10 substantially as shown in FIG. 2. The outer diameter of the barrier 20 substantially slightly smaller than the inner diameter of an inner container structure, as will be described later. The barrier 20 of the above construction is provided for preventing spatters of molten metal, which may be formed upon boiling of the additive introduced into the molten metal because of the difference between the melting point of the additive and the temperature of the molten metal, from excaping out of the ladle 10 and also from sticking to an inner wall portion of the ladle 10 adjacent the top opening.

Figure 3:
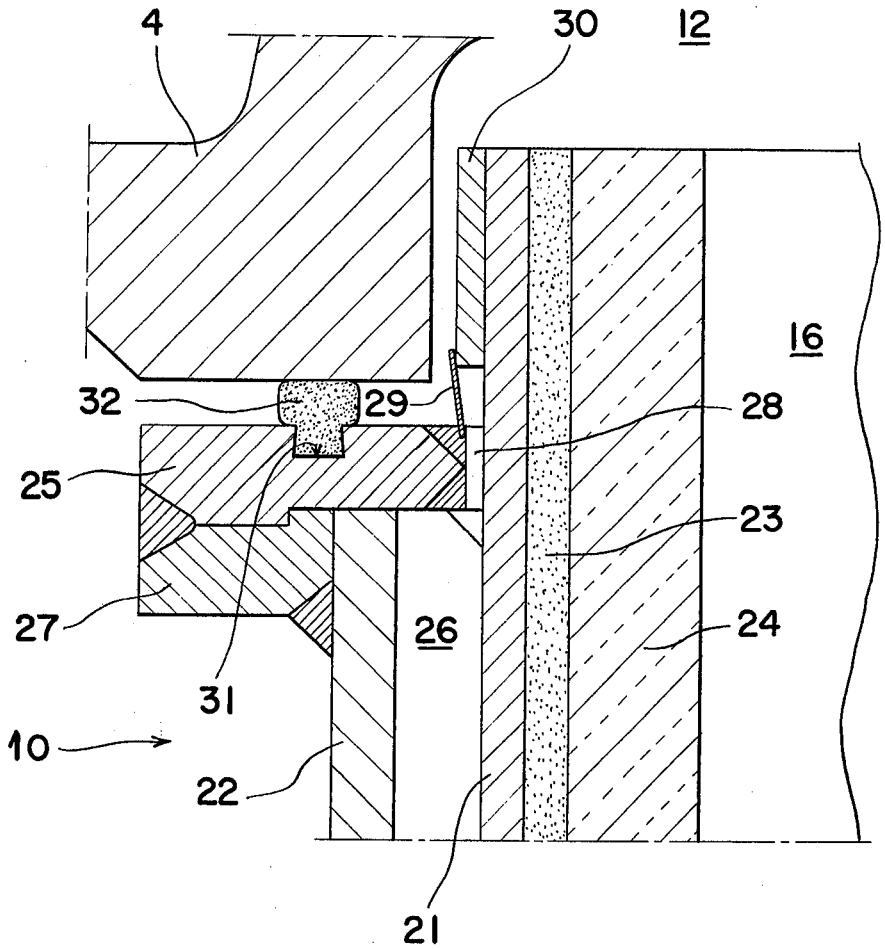
FIG. 3 is a sectional view, on an enlarged scale, of a portion of the ladle structure showing the details of connection between inner and outer containers and between the container assembly and the lid.

The details of the ladle 10 will now be described with particular reference to FIGS. 2 and 3.

As best shown in FIG. 2, the ladle 10 comprises inner and outer open-topped containers 21 and 22. These containers 21 and 22 are of similar shape, but the inner container 21 has a greater height than that of the outer container 22.

With respect to the inner container 21, it is formed by a substantially cylindrical wall 21*a* having one end open and the other end closed by a bottom wall 21*b*. The whole inner surface of the inner container 21, that is, all of the inner surfaces of the walls 21*a* and 21*b*, is lined with a refractory lining 24, which may be made up of refractory brick, with a lining of castable 23 interposed between the refractory lining 24 and said walls 21*a* and 21*b*.

Adjacent the open end of the wall 21*a* and spaced a predetermined distance from the plane of the opening of the ladle 10, there is formed an annular flange 25 integral with, or otherwise rigidly connected to, and radially outwardly extending from the outer peripheral surface of the wall 21*a*.

Adjacent the outer peripheral surface of the cylindrical wall 21*a* of the inner container 21, a plurality of vent passages 29 are formed in the annular flange 25 preferably in equally spaced relation to each other with respect to the longitudinal axis of the inner container 21. Each of these vent passages 29 communicates between an adiabatic space 26 and a working chamber will be described later. As best shown in FIG. 3, a reinforcement ring 30 of a substantially cylindrical shape is rigidly mounted on a portion of the outer peripheral surface of the wall 21*a* and between the open end of said wall 21*a* and the position of said annular flange 25 with an adjacent end face of said ring 30 overhanging the vent passages 28.

While the inner container 21 is constructed as herein before described, it is to be noted that the outer diameter of the barrier 20 is substantially slightly smaller than the inner diameter of the refractory lining 24.

With respect to the outer container 22, it is likewise formed by a substantially cylindrical wall 22*a* and a bottom wall 22*b* rigidly secured to a lower end of the wall 22*a*. Intermediately of the height of the outer container 22, the trunnions 34 referred to hereinbefore are secured to the outer peripheral surface of the wall 22*a*. in any known manner.

The cylindrical wall 22*a* has an upper end formed with an annular flange 27 integral with, or otherwise rigidly connected to, and radially outwardly extending from the outer peripheral surface of the wall 22*a*. Radially outwardly extending from the outer peripheral surface of the wall 22*a* and immediately below the annular flange 27 a pair of 180° spaced lugs 33 for connection with lifting cables in case of removal of the ladle 10 from the carriage 8.

Reference numeral 35 represents brackets secured to the outer peripheral surface of the wall 22*a* adjacent the lower end of the container 22. Through these brackets 35, the ladle 10 can be mounted on the carriage 8. It is to be noted that each of these brackets 35 has a downwardly inclined guide 36 for facilitating positioning of the ladle on the carriage 8 in alignment with the center of the carriage 8.

While the inner and outer containers 21 and 22 are respectively constructed as hereinbefore described, the inner container 21 is inserted into the outer container 22 with the annular flange 25 resting on and rigidly connected, or otherwise, welded, to the annular flange 27. In this assembled condition, the adiabatic space 26 is formed between the inner and outer containers 21 and 22. This adiabatic space 26 is, when the ladle 10 is upwardly shifted to the elevated position with the lid 4 closing the top opening of the ladle 10 in the manner as shown in FIG. 2, communicated through the vent passages 28 to the working chamber which is defined by the cavity 12, hollow 12*a* and a space 16 above the surface level of the molten metal within the inner container 21.

In order to keep the adiabatic space 26 and working chamber is substantially hermetically sealed condition when the lid 4 is in position to close the top opening of the ladle 10 as shown in FIG. 2, a gasket 32 of a substantially ring shape is engaged in part in a mounting groove 31 formed in the annular flange 25 and in part outwardly projects from said annular flange 25 for tight contact with the lid 4.

In addition, in order to avoid any possible entrance into the adiabatic space 26 of foreign matters and/or spatters of molten metal and also to prevent the gasket 32 from being burnt under the influence of the elevated temperature, cover plates 29, equal in number to the number of the vent passages 28 and of a width greater than the cross sectional area of the corresponding vent passage 28, are provided each having one end welded to the annular flange 25 adjacent the corresponding vent passage 28 and the other end abutted against the adjacent end of the reinforcement ring 30 secured to the inner container 21. It is to be noted that, even though the cover plates 29 are employed one for each vent passage 28 to substantially overhang the corresponding vent passages in cooperation with the adjacent end face of the reinforcement ring 30, communication between the adiabatic space 26 and the working chamber when the lid 4 is in position to close the top opening of the ladle 10 can advantageously be preserved by way of a clearance between the end face of the reinforcement ring 30 and the annular flange 25.

When the ladle 10 of the construction as hereinbefore fully described is to be used in the practice of the previously described method for the purpose of, for example, making a nodular graphite cast iron, a required amount of metallic additive such as graphite spherulitic alloys including magnesium is filled in the refractory container 11. Since the refractory container 11 is in the form of a perforated box, the metallic additive, for example, magnesium, is filled therein in the form of lumps of a size greater than the size of each perforation. The refractory container 11 is subsequently connected to the piston rod 13 and thereafter upwardly shifted by the operation of the cylinder 14 to position whithin the cavity 12 as shown in FIGS. 1 and 2.

Thereafter, the ladle 10 mounted on the carriage 8 is, after a predetermined amount of molten cast iron has been poured thereinto from a converter (not shown) or otherwise from a melting furnace (not shown), transported along the rails 9 to a location where the ladle 10 is aligned with the lid 4 and immediately below the refractory container 11 and also immediately above the movable platform 6. At this location, by the operation of the cylinder 15, the movable platform 6 is upwardly elevated with the consequence of the laddle 10 being upwardly shifted from the rest position towards the elevated position.

When the ladle 10 arrives at the elevated position, the lid 4 closes the top opening of the ladle 10 as shown in FIG. 10. At this time, the adiabatic space 26 and the working chamber defined by the cavity 12, the hollow 12*a* and the space 16 above the surface level of the molten metal within the ladle 10 are substantially hermetically sealed from the atmosphere by the interposition of the gasket 32.

While the ladle 10 is closed by the lid 4 in the manner as hereinbefore described, the adiabatic space 26 and the working chamber are pressurized by the application air or inert gaseous medium introduced thereinto. Subsequent thereto, the cylinder 14 is again operated to allow the piston rod 13 to downwardly shift with the refractory container 11 immersed into the molten metal within the ladle 10. Upon introduction of the magnesium into the molten metal in this way, the magnesium successively undergoes melting, boiling and vaporizing actions, during which the pressure within the working chamber and, hence, the adiabatic space 26 is controlled to attain a value within the range of 70 to 85% of the vapor pressure of the magnesium. By so doing this way, a major portion of the magnesium is fused into the molten metal thereby being prevented from escaping out of the molten metal while the remaining portion of the magnesium is boiled in the molten metal to undergo a stirring action so that particles of the magnesium can uniformely be dispersed into the molten metal.

Therefore, it will readily be seen that the magnesium used is used in good yield to spherodize a graphite component of the molten cast iron.

In practice, however, the speed of vaporization of the magnesium added varies greatly depending upon the temperature of the molten cast iron at the time of addition. Specifically, at a relatively low temperature of the molten cast iron, the vaporization speed is so low that the boiling of the magnesium will not give a sufficient stirring force. On the contrary thereto, at a relatively high temperature of the molten cast iron, the vaporization speed is so high that the yield will be lowered. In view of this and in consideration of the time during which reaction is taking place, controlling and checking or monitoring are carried out.

It is to be noted that, during the reaction taking place upon addition of the magnesium to the molten cast iron, the pressure within the adiabatic space 26 is, through the vent passages 28, equalized to that within the working chamber and, therefore, the pressure within the adiabatic space 26 acts as a counter-pressure with respect to the pressure exerted on the inner container 21 from the molten cast iron. Therefore, there is no substantial possibility of the inner container 21 being broken by the effect of a considerably high pressure which may be exerted upon rapid vaporization of the magnesium being added.

Preferably, in order to allow the ladle 10 to withstand against a momentary increase of pressure resulting from rapid vaporization of the magnesium being added, setting of the initial pressure within the working chamber and, hence, the adiabatic space 26, is made to a value equal to 25 to 90% of the vapor pressure, such as set forth in the table, with respect to the molten cast iron of a particular temperature. In this case, as the reaction proceeds, the pressure within the working chamber is increased by the vapor pressure exerted upon addition of the magnesium into the molten cast iron and, therefore, it may be necessary to maintain the pressure within the working chamber within the predetermined range either by discharging gaseous medium within the working chamber to the atmosphere or by cooling the working chamber.

According to a series of experiment conducted by the inventor, it has been found that the yield of the magnesium used was not less than 70%, as compared with 7 to 45% according to the conventional methods (1) and (2) described hereinbefore, and that the graphite component of the cast iron to which magnesium had been added was substantially completely spherodized.

Furthermore, in the practice of the method of the invention, an enriched molten metal, that is, molten metal to which additive is introduced in an amount greater than required, can be prepared. Where the enriched molten metal is prepared in the ladle of the present invention, it can be diluted to a desired or required composition of the resultant metallic material merely by pouring the enriched molten metal into the container in which molten metal with no additive therein has been contained. To this end, the ladle tilting mechanism hereinbefore described may be operated after the ladle 10 has been transported to the subsequent processing station together with the carriage 8 along the rails 9. The brackets 18, at this time, receive the respective trunnions 34 to support the ladle 10 in readiness for tilting of the ladle 10. It is to be noted that the carriage 8 may be retracted from a position immediately below the ladle 10 supported by the bracket 18 through the trunnions 34, prior to the complete return of the movable platform 6 to a downwardly retracted position.

The present invention having been described above, it is clear that the ladle structure constructed according to the teachings of the present invention does not require any external stirring instrument. Uniform distribution of particles of the metallic additive can advantageously be achieved by way of boiling action.

Although the present invention has been fully described in conjunction with the preferred embodiment thereof, it should be noted that various changes and modifications are apparent to those skilled in the art. Such changes and modifications should be construed as included within the true scope of the present invention unless they depart therefrom.

What is claimed is:

1. A method of adding a metallic additive to a molten metal having a temperature higher than the boiling point of said metallic additive, with the use of a double walled ladle structure which comprises an inner container, the interior surface of which is lined with a refractory lining, and an outer container in which the inner container is accommodated with an adiabatic space formed therebetween, a plurality of vent passages formed in an annular flange radially outwardly extending from the inner container adjacent the top opening of the inner container, and a lid adapted to close the top opening of the inner container and, therefore, that of the ladle structure to define a substantially hermetically sealed working chamber substantially above the surface level of the molten metal within the ladle structure, which working chamber is communicated with the adiabatic space through the vent passages, which method comprises:

a step of placing the lid onto the top opening of the lid structure to close said top opening with the molten metal therein while the metallic additive is accommodated in a refractory container carried by said lid;

a step of introducing through said refractory container the metallic additive into the molten metal; and a step of adjusting the pressure within the working chamber and the adiabatic space to a value within the range of 70 to 85% of the vapor pressure evolved by the vaporization of said metallic additive upon introduction thereof into said molten metal.

2. A method as claimed in claim 1, wherein said metallic additive is magnesium and said molten metal is a cast iron.

3. A method as claimed in 2, wherein said vapor pressure of said magnesium is within the range of from 3.5 to 14.5 kg/cm$^2$ when the temperature of said molten cast iron is within the range of 1,300° to 1,500° C.

* * * * *